US007112737B2

(12) United States Patent
Ramstein

(10) Patent No.: US 7,112,737 B2
(45) Date of Patent: Sep. 26, 2006

(54) SYSTEM AND METHOD FOR PROVIDING A HAPTIC EFFECT TO A MUSICAL INSTRUMENT

(75) Inventor: Christophe Ramstein, San Francisco, CA (US)

(73) Assignee: Immersion Corporation, San Jose, CA (US)

( * ) Notice: Subject to any disclaimer, the term of this patent is extended or adjusted under 35 U.S.C. 154(b) by 64 days.

(21) Appl. No.: 10/891,227

(22) Filed: Jul. 15, 2004

(65) Prior Publication Data

US 2005/0145100 A1 Jul. 7, 2005

Related U.S. Application Data

(60) Provisional application No. 60/533,671, filed on Dec. 31, 2003.

(51) Int. Cl.
*G10H 7/00* (2006.01)

(52) U.S. Cl. ..... 84/645

(58) Field of Classification Search ..... 84/645; 345/156

See application file for complete search history.

(56) References Cited

U.S. PATENT DOCUMENTS 3,157,853 A 11/1964 Hirsch
3,220,121 A 11/1965 Cutler
3,497,668 A 2/1970 Hirsch
3,517,446 A 6/1970 Corlyon et al.
3,902,687 A 9/1975 Hightower
3,903,614 A 9/1975 Diamond et al.
4,160,508 A 7/1979 Salsbury
4,236,325 A 12/1980 Hall et al.
4,513,235 A 4/1985 Acklam et al.
4,581,491 A 4/1986 Boothroyd
4,599,070 A 7/1986 Hladky et al.
4,708,656 A 11/1987 De Vries et al.
4,713,007 A 12/1987 Alban
4,891,764 A 1/1990 McIntosh
4,930,770 A 6/1990 Baker
4,934,694 A 6/1990 McIntosh
5,019,761 A 5/1991 Kraft
5,022,407 A 6/1991 Horch et al.
5,035,242 A 7/1991 Franklin
5,038,089 A 8/1991 Szakaly
5,078,152 A 1/1992 Bond
5,186,695 A 2/1993 Mangseth et al.
5,189,242 A * 2/1993 Usa ..... 84/743
5,212,473 A 5/1993 Louis
5,240,417 A 8/1993 Smithson et al.
5,271,290 A 12/1993 Fischer (Continued)

*Primary Examiner*—Jeffrey W Donels
(74) *Attorney, Agent, or Firm*—Kilpatrick Stockton LLP

(57) ABSTRACT

A system and method for providing a haptic effect to a musical instrument is described. One method described comprises receiving a first signal having a set of parameters relating to sound, determining a haptic effect associated with at least one predetermined parameter from the set of parameters, and outputting a second signal associated with the haptic effect. The haptic effect can be determined using at least one predetermined parameter from the set of parameters to select the haptic effect from a database having one or more look-up tables. The second signal is provided to an actuator for causing a haptic effect at the musical instrument in response to receiving the second signal. The second signal can be applied to an input member, such as a key on a keyboard or a string on a guitar, or to the housing of the musical instrument, such as the neck of a guitar.

23 Claims, 4 Drawing Sheets

U.S. PATENT DOCUMENTS

| | | | | |
|---|---|---|---|---|
| 5,275,174 | A | 1/1994 | Cook | |
| 5,299,810 | A | 4/1994 | Pierce | |
| 5,309,140 | A | 5/1994 | Everett | |
| 5,334,027 | A | 8/1994 | Wherlock | |
| 5,466,213 | A | 11/1995 | Hogan | |
| 5,547,382 | A | 8/1996 | Yamasaki | |
| 5,766,016 | A | 6/1998 | Sinclair | |
| 5,785,630 | A | 7/1998 | Bobick et al. | |
| 6,111,577 | A | 8/2000 | Zilles et al. | |
| 6,219,034 | B1 | 4/2001 | Elbing et al. | |
| 6,422,941 | B1 | 7/2002 | Thorner et al. | |
| 2003/0068053 | A1* | 4/2003 | Chu | 381/118 |
| 2004/0130526 | A1* | 7/2004 | Rosenberg | 345/156 |
| 2004/0161118 | A1* | 8/2004 | Chu | 381/61 |

* cited by examiner

SYSTEM AND METHOD FOR PROVIDING A HAPTIC EFFECT TO A MUSICAL INSTRUMENT

CROSS-REFERENCE TO RELATED APPLICATIONS

This application claims priority to U.S. Provisional Application No. 60/533,671, filed Dec. 31, 2003, the entire disclosure of which is incorporated herein by reference.

NOTICE OF COPYRIGHT PROTECTION

A portion of the disclosure of this patent document and its figures contains material subject to copyright protection. The copyright owner has no objection to the facsimile reproduction by anyone of the patent document, but otherwise reserves all copyrights whatsoever.

FIELD OF THE INVENTION

The present invention generally relates to providing haptic effects. The present invention more particularly relates to providing haptic effects to a musical instrument.

BACKGROUND

Designers and manufacturers of musical equipment, such as electronic pianos, are constantly striving to improve the musical equipment. For example, designers and manufacturers continue striving to make electronic instruments perform and feel like non-electronic musical instruments. One difference between electronic instruments and non-electronic instruments is that many electronic instruments typically provide little to no realistic haptic effects. As a result, musicians playing many electronic instruments can only hear the music and cannot achieve a satisfying feel of playing the music. In other words, pressing down on a key on an electronic keyboard feels differently than pressing down on a key on a piano, as there is generally no appreciable vibration from the key on the electronic keyboard and/or no appreciable resistance from the key on the electronic keyboard that is usable in an effective manner by most users of electronic musical instruments.

Another area for improvement is teaching musical instruments. Traditionally, a student watches a teacher play an instrument, and the student learns visually and acoustically. Piano lessons are typically taught with a student sitting next to a teacher with the teacher playing the piano thus demonstrating how to play a particular melody. Since the student does not have their fingers on the keyboard, the student cannot feel haptic feedback on the keys of the piano. Thus, the student cannot feel, in an effective and efficient manner, the instructor pressing down harder on one key than the other keys.

Thus, a need exists for methods and systems for providing haptic effects to a musical instrument.

SUMMARY

Embodiments of the present invention provide systems and methods for providing a signal associated with a haptic effect to a musical instrument. One aspect of one embodiment of the present invention comprises receiving a first signal having a set of parameters relating to sound, selecting a haptic effect from a database, the selection being associated with at least one predetermined parameter from the set of parameters, and outputting a second signal associated with the haptic effect.

BRIEF DESCRIPTION OF THE DRAWINGS

These and other features, aspects, and advantages of the present invention are better understood when the following Detailed Description is read with reference to the accompanying drawings, which constitute part of this specification.

DETAILED DESCRIPTION

Embodiments of this invention are described herein in the context of musical instruments. Embodiments of the invention can also be used in other contexts such as cell phones, PDAs, game controllers, surgical simulators, or any other system or method employing haptic effects. The phrase MIDI signal refers to signals using the MIDI protocol. MIDI signals refer to signals generated in accordance with the MIDI protocol, e.g., MIDI messages. Although, the detailed description uses MIDI signals/protocol as an example, other signals and/or protocols such as the Synthetic music Mobile Application Format ("SMAF") protocol developed by the Yamaha Corporation of America can be utilized in accordance with embodiments of the present invention.

Figure 1:
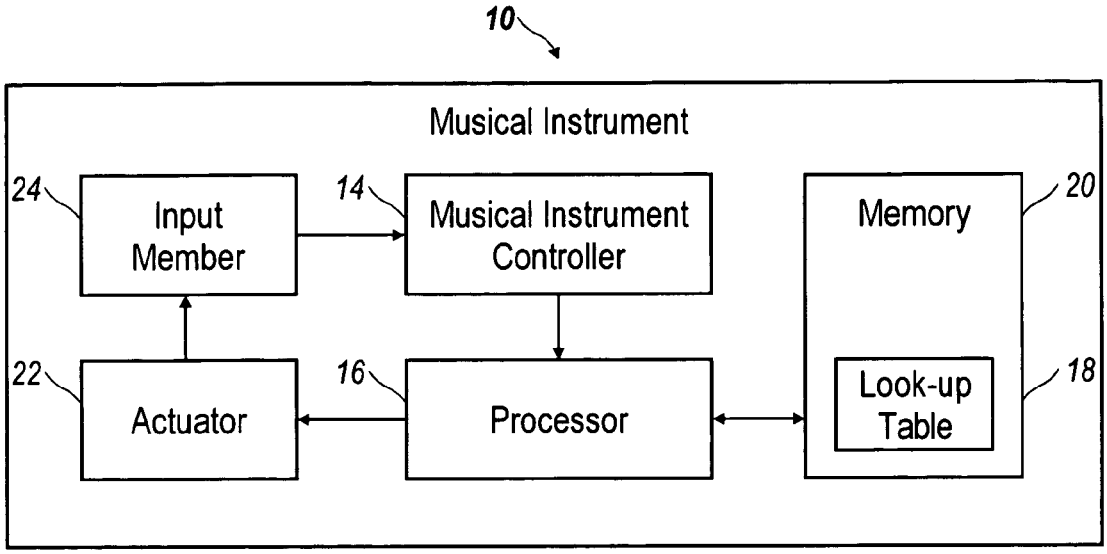
FIG. 1 is a block diagram of an exemplary system for providing a signal associated with a haptic effect to a musical instrument in accordance with an embodiment of the present invention.
Figure 2A:
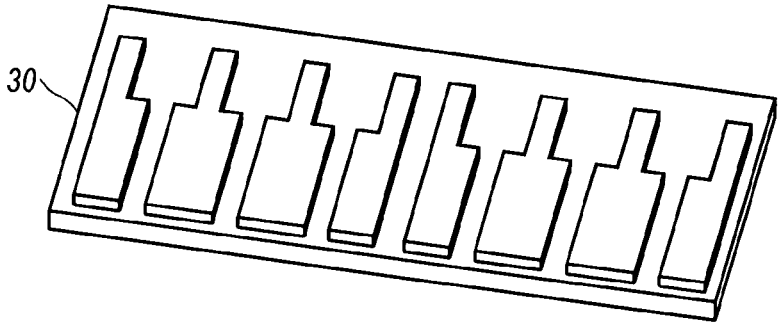
FIGS. 2A–2E are different views of exemplary instruments in accordance with different embodiments of the present invention.
Figure 2B:
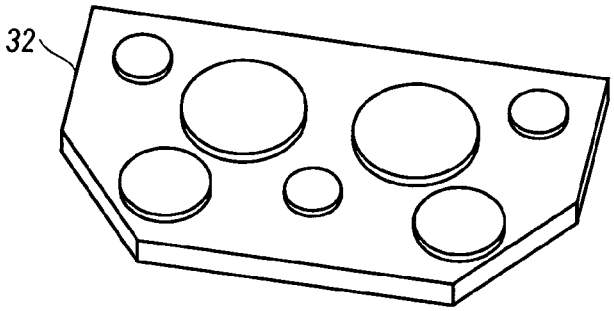
Figure 2D:
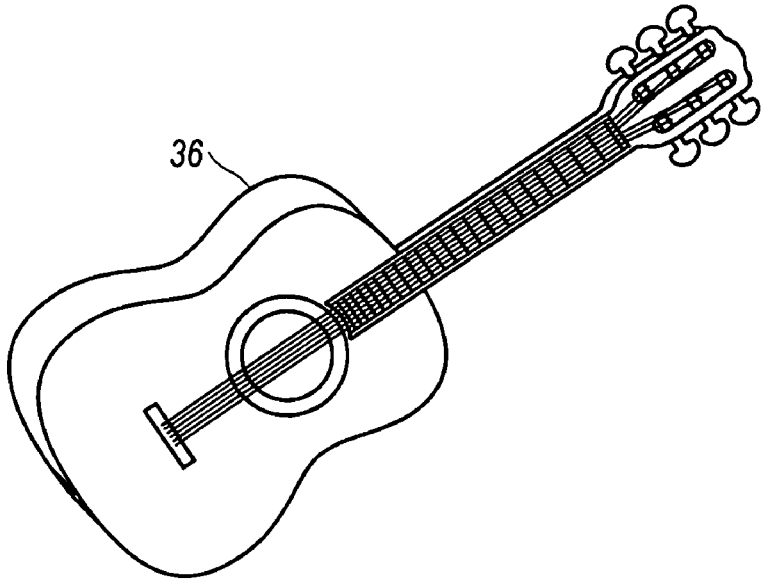
Figure 2C:
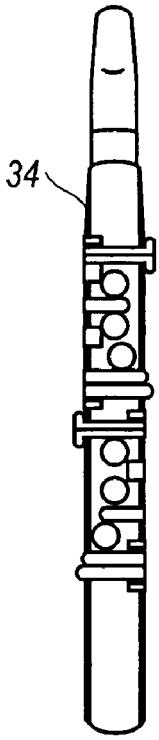
Figure 2E:
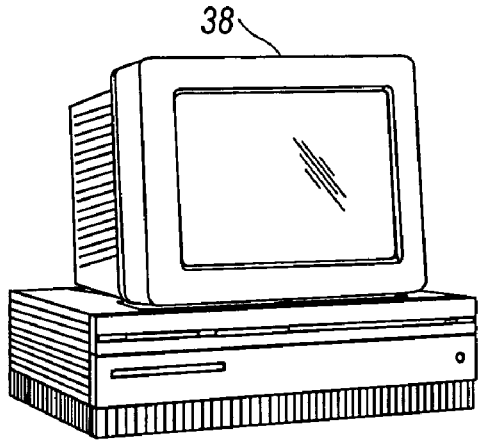

Referring now to the drawings in which like numerals indicate like elements throughout the several figures, FIG. 1 illustrates a block diagram of an exemplary system 10 for providing a signal associated with a haptic effect to a musical instrument in accordance with one embodiment of the present invention. As shown in FIG. 1, the system 10 comprises a musical instrument 12. The musical instrument can include, for example, a keyboard 30 (FIG. 2A), a drum pad 32 (FIG. 2B), a wind controller 34 (FIG. 2C), a guitar 36 (FIG. 2D), and a computer 38 (FIG. 2E) configured to produce music, or any suitable musical instrument.

Referring to FIG. 1 again, the musical instrument 12 can further include a musical instrument controller 18 configured to generate a first signal having a set of parameters relating to sound. The first signal can be, but is not limited to, a music signal, a MIDI signal, or other signals as known in the art. Examples of the parameters relating to sounds can include, but are not limited to, start, delay, duration, waveform, frequency, magnitude, and envelope (attack time, attack level, fade time, fade level, etc.). Some of the parameters can be time varying. The parameters can be MIDI parameters and can include, but are not limited to, MIDI note number, note velocity, note duration, note volume, channel number, patch number, MIDI notes, or another parameter or variable that can be associated with a MIDI signal.

The musical instrument controller 18 can generate one or more first signals in response to a musician playing the musical instrument 12 as known in the art. For example, the music instrument controller 18 can generate a first signal in response to a musician actuating an input member 24 on the musical instrument 12, such as pressing down on a key on a keyboard or strumming a guitar string on a guitar. An input member 24 comprises a member associated with sound, music, or a musical instrument that can be actuated directly or indirectly by a user. Examples include, as mentioned, a keyboard key or a guitar string. Examples also include a computer-keyboard key, or another type of key or button. When an input member 24 is actuated, a sensor can detect the event and send one or more sensor signals to the musical instrument controller 14. The musical instrument controller 14 can be configured to generate one or more first signals in response to receiving the one or more sensor signals. In another embodiment, the musical instrument controller 18 can be configured to generate one or more first signals, e.g., MIDI signals, in response to reading a file, e.g., a MIDI file, stored in memory 20. The file can be correlated to various events as known in the art. In yet another embodiment, the music instrument controller 14 can receive the first signal from the musical instrument 12 via a microphone (not shown).

The system 10 can further include a processor 16 configured to receive a first signal, e.g., a MIDI signal, and determine one or more haptic effects, which are correlated to the first signal. The processor 16 is configured to execute computer-executable program instructions stored in memory 20. Such processors can include any combination of one or more microprocessors, ASICs, and state machines. Such processors include, or can be in communication with, media, for example computer-readable media 20, which stores instructions that, when executed by the processor, cause the processor to perform the steps described herein. Embodiments of computer-readable media include, but are not limited to, an electronic, optical, magnetic, or other storage or transmission device capable of providing a processor with computer-readable instructions. Other examples of suitable media include, but are not limited to, a floppy disk, CD-ROM, DVD, magnetic disk, memory chip, ROM, RAM, an ASIC, a configured processor, all optical media, all magnetic tape or other magnetic media, or any other medium from which a computer processor can read instructions. Also, various other forms of computer-readable media can transmit or carry instructions to a computer, including a router, private or public network, or other transmission device or channel, both wired and wireless. The instructions can comprise code from any suitable computer-programming language, including, for example, C, C+, C++, Visual Basic, Java, Python, and JavaScript. The controller 14 shown in FIG. 1 can comprise such a processor.

Referring still to FIG. 1, the processor 16 can be configured to receive the first signal having a set of parameters relating to sound and to generate a second signal associated with a haptic effect. In one embodiment, the processor 16 can use one or more look-up tables 18 stored in memory 20 to determine the haptic effect corresponding to the first signal, e.g., MIDI signal. The look-up tables 18 can be stored in a database that can be stored in memory 20. The look-up tables 18 can be pre-programmed by the manufacturer of the musical instrument, provided as a third-party add-on to the instrument, provided as a stand-alone module, programmed by the user or a third party, or provided in any other suitable manner. In one embodiment, the look-up tables 18 contain parameters relating to sound that can be mapped to zero or more haptic effects, with the haptic effects being controlled by the parameters associated with the sound. In other embodiments, including the embodiment shown in FIG. 1, signals having parameters, e.g., MIDI signals, are mapped to haptic effects and can be based on a predetermined parameters, e.g., the note number, such as a MIDI note number, note velocity, note duration, note volume, channel number, patch number, notes, MIDI notes, or another parameter or variable that can be associated with a first signal. As a result, the haptic effect can correlate to, for example, the characteristics of the input from the musician. In other words, the haptic effects may not be limited to an on/off signal (e.g., either 100% on or 100% off), but rather can allow for different characterization of different instruments having varying magnitude and frequency.

In another embodiment, the processor 16 can be configured to compute the second signal based on the first signal, e.g. MIDI signal. For example, the second signal can be computed as a waveform based on attributes of a predetermined parameter, e.g., a MIDI note. Some of the attributes controlling the second signal can be pre-defined and selectable by particular combinations of MIDI signals, while other attributes can be computed from the first signal. For example, the patch number for a note can select a specific communication of waveform and envelope parameters while the note number and duration can modify the frequency, magnitude and envelope parameters. The resulting haptic effect frequency can be different from the MIDI signal frequency.

Regardless of how the second signal is produced, e.g., via look-up table or computed, certain parameters such as duration and amplitude of the second signal can be the same for each (independent of the first signal), can match or correlate to the parameters of the first signal (dependent on the first signal), or can be musical instrument dependent. For example, in response to receiving a first signal, a second signal is produced (e.g., converted first signal) in which certain parameters can be set to predefined values which are independent of the parameters of the first signal. In such an embodiment, the parameters of the resulting haptic effects can be the same regardless of the duration and amplitude of the musician striking an input member 24 to cause a first signal to be generated.

In another example, the parameters of the second signal can correlate to the parameters of the first signal, e.g., the parameters of the second signal are dependent on the parameters of the first signal. In such an embodiment, the haptic effect can match the first signal, e.g., the parameters of the haptic effects being applied to the housing of the guitar can match the parameters of the strumming of a string on the guitar. In yet another embodiment, the second signals can be musical instrument dependent where the parameters of the second signal are set to predefined values with the predefined values varying among instruments. In such an embodiment, certain parameters of the resulting haptic effects are set to the same values, e.g., the duration and amplitude of the haptic effects are the same for a given instrument, but vary between instruments.

Referring again to FIG. 1, the system 10 can further include one or more actuators 22 configured to receive the second signal and provide the associated haptic effect to one or more input members 24 or to a surface or the housing of the musical instrument 12. The haptic effects can be kinesthetic feedback (such as, without limitation, active and resistive force feedback), and/or tactile feedback (such as, without limitation, vibration, texture, and heat). The haptic effects can be any combination of the feedback, e.g., a hybrid. The haptic effect and the amplification of the music can be synchronized or asynchronized.

One or more actuators 22 can be coupled to a corresponding input member 24. In one embodiment, each input member 24 can be coupled to a corresponding actuator 22. In one embodiment, the one or more haptic effects can be provided to the input member 24 which caused the first signal to be generated. For example, the haptic effect is provided to a keyboard key that the musician has pressed down, or to a guitar string that the musician strummed. In yet another embodiment, the one or more haptic effects can be provided to the input member 24 which caused the first signal to be generated and to one or more input members 24 which correspond to the input member 24 which caused the generation of the first signal with the corresponding input member or members being on a different scale. For example, if a teacher presses down on a key on a electronic keyboard, the haptic effect is provided to the key that was pressed down and one or more corresponding keys on one or more different scales. In such an embodiment, a student could feel the haptic effect on a corresponding key.

In one embodiment, one or more actuators 22 are coupled to a surface or housing of a musical instrument 12 and apply the one or more haptic effects to the surface or housing of the musical instrument 12 with one or more haptic effects being associated with one or more first signals. For example, one or more actuators 22 are coupled to the body or neck of a guitar, the body of a wind instrument, or to the drum pad of a drum.

Various types of actuators can be utilized in different embodiments of the present invention. These actuators can provide any combination of vibrational feedback, force feedback, resistive feedback, or any kind of haptic feedback appropriate for a given effect. For example, in one embodiment, a motor can provide a rotational force. In another embodiment, a motor can drive a belt that is configured to produce a rotational force directly or indirectly on an input member 24 or to the housing of a musical instrument 12. In yet another embodiment, a motor can be connected to a flexure, such as a brass flexure, which produces rotational force on the input device. Exemplary actuators are described in further detail in PCT Patent Application No. PCT/US03/33202 having an international filing date of Oct. 20, 2003, the entire disclosure of which incorporated herein by reference.

In addition, the processor 16 can send the second signals to the one or more actuators 22 using channels (e.g., ten (10) channels). For keyboards and computers configured to produce music, using multiple channels can allow the actuators 22 to produce multiple haptic effects. In such an embodiment, a first actuator can produce haptic effects associated with a first instrument and a second actuator can produce haptic effects associated with a second instrument with the haptic effects occurring at the same time. In addition, musical instruments can be assigned specific channels. For example, drums can be assigned to a first channel and guitars can be assigned to a second channel. In another example, a snare drum can be assigned to a first channel and bass drum can be assigned to a second channel. Channel assignment can be assigned by the manufacturer of the musical instrument, assigned by the user or a third party, or provided in any other suitable manner.

Figure 3:
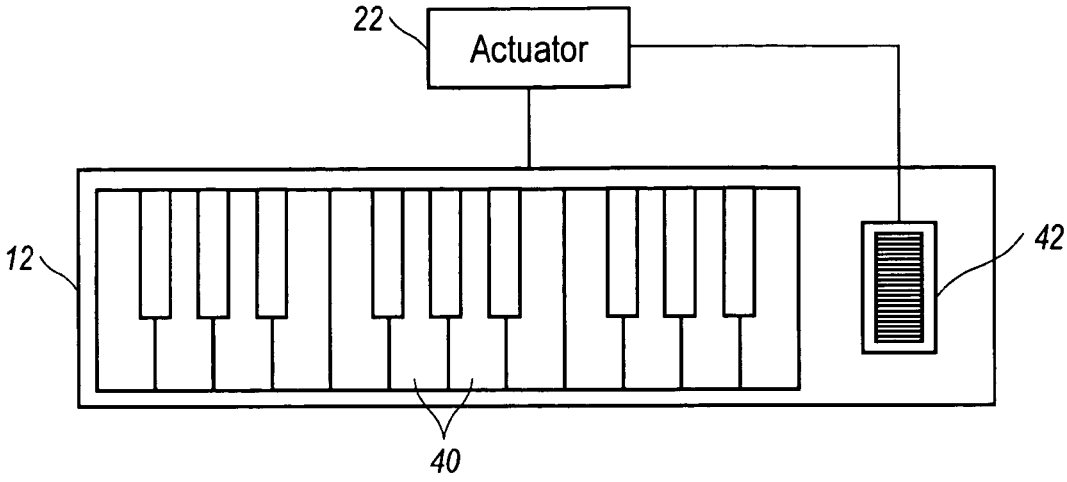
FIG. 3 is a perspective view of keys on a keyboard and a pitch bend having an associated actuator in accordance with an embodiment of the present invention.

Referring to FIG. 3, a perspective view of a keyboard in accordance with an exemplary embodiment of the present invention is illustrated. As shown, the keyboard 12 includes a plurality of input members—keys 40 and a rotary control 42 (e.g., a pitch bend) with one or more actuators 22 providing the one or more haptic effects to the input members 40, 42. The pitch bend 42 produces a change in pitch in response to the movement of a pitch bend wheel or lever. The actuator 22 can provide the haptic effect in the form of kinesthetic feedback in response to the movement of the pitch bend 42 or can provide a haptic effect in the form of tactile feedback in response to the effect of the movement of the pitch bend 42 as described above. Exemplary actuators that can provide resistance for a pitch bend are described in further detail in U.S. patent application Ser. No. 10/314,400 having a filing date of Dec. 8, 2002, the entire disclosure of which incorporated herein by reference. For example, the actuator 22 applies the haptic effects to the spring of the pitch bend 42 thus simulating resistance on the pitch bend 42.

Similarly, one or more actuators 22 can provide the haptic effect to a pitch bend arm on a guitar (not shown). The actuators 22 can provide the haptic effect in the form of kinesthetic feedback in response to the movement of the pitch bend arm or can provide a haptic effect in the form of tactile feedback in response to the effect of the movement of the pitch bend arm as described above.

Figure 4:
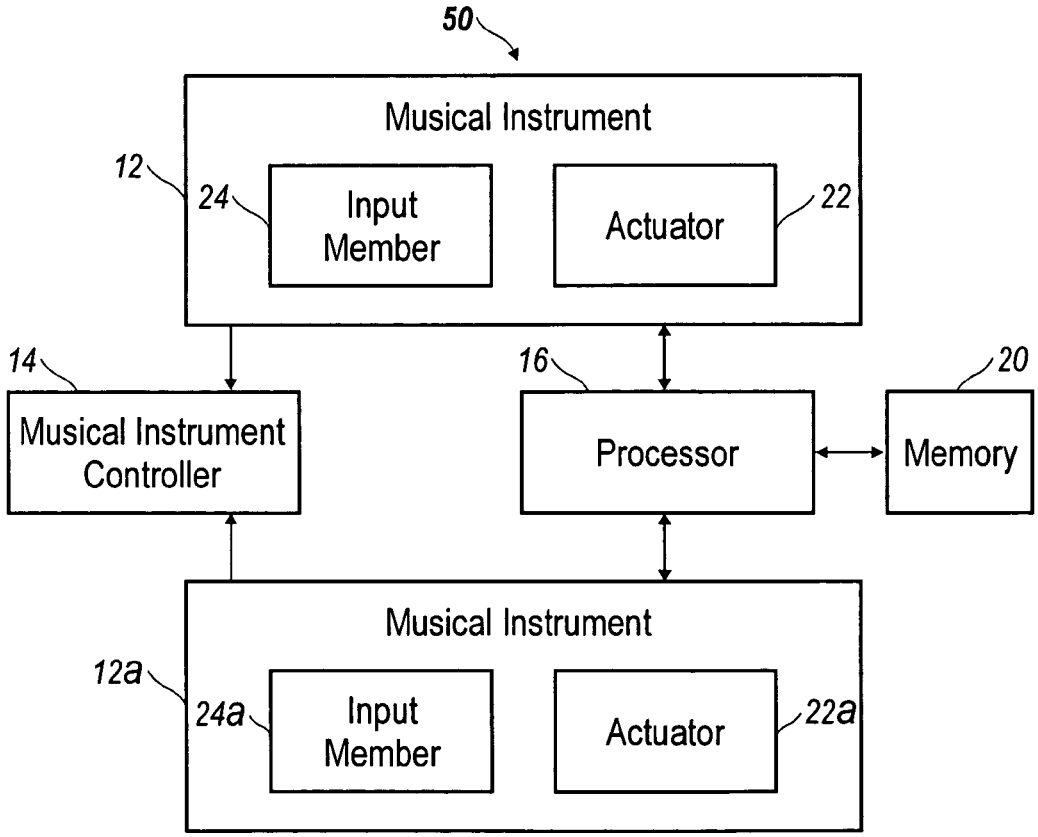
FIG. 4 is a block diagram of an exemplary system for providing a signal associated with a haptic effect to a musical instrument in accordance with an embodiment of the present invention.

Referring to FIG. 4, a block diagram of an exemplary system 50 for providing a signal associated with a haptic effect to a musical instrument in accordance with an embodiment of the present invention is illustrated. As shown in FIG. 4, the system 50 includes a musical instrument 12, a musical instrument controller 14, and a processor 16 with each being an individual component. In an alternate embodiment, the music instrument controller 14 can be part of the musical instrument 12. In another alternate embodiment, the music instrument controller 14 and the processor 16 can be combined.

As shown in FIG. 4, the musical instrument controller 14 is separate from the musical instrument 12 and can be a pickup controller for the musical instrument 12, e.g., a pick-up controller for a guitar. In one embodiment, the musical instrument controller 14 can be configured to receive sensor signals based on user input, e.g., a musician pressing a key on a keyboard or strumming the string on a guitar. The musical instrument controller 14 can be configured to generate one or more first signals based on the sensor signals. In another embodiment, the musical instrument controller 14 can be configured to generate one or more first signals, e.g., MIDI signals, in response to reading a file, e.g., a MIDI file, stored in memory 20. The file can be correlated to various events as known in the art. The processor 16 is configured to generate second signals associated with one or more haptic effects correlated to the one or more first signals.

In another embodiment, the processor 16 can be configured to receive one or more first signals from the musical instrument 12 either directly or via a wireless connection. In this other embodiment, the processor 16 does not require the use of a musical instrument controller 14. Hence, the processor 16 can receive one or more first signals and generate one or more second signals associated with one or more haptic effects correlated to the one or more first signals. For example, the musical instrument 12 can be a player piano, in which the stored signals are reproduced on the player piano, e.g., the player's touch timing, velocity, duration and release.

In yet another embodiment, the system 10, 50 can include more than one musical instrument 12. For example, as shown in FIG. 4, a first instrument 12 and a second instrument 12*a* can be coupled with the processor 16 being configured to receive one or more first signals from one of the musical instruments 12, 12*a* and/or from one or more first signals stored in memory 20. The processor 16 can be configured to convert the one or more first signals into one or more second signals that are provided to one or more of the coupled musical instruments, e.g., the first musical instrument 12 and/or the second musical instrument 12*a*. In addition, the musical instruments 12, 12*a* can be different instruments. For example, the first musical instrument 12 can be a guitar and the second musical instrument 12*a* can be a keyboard. In embodiments in which the second signal is being provided to a musical instrument that caused the first signal, the second signal can be referred to as a haptic feedback signal. For example, if two musical instruments are coupled via the processor 16, the musical instrument 12, 12*a* that caused the music signal can receive the haptic feedback signal and the other musical instrument 12*a*, 12 would receive a second signal which matches the haptic feedback signal. If the two musical instruments 12, 12*a* are different musical instruments, then the haptic effect can be provided to an input member 24 corresponding to the input member 24 which generated the first signal.

Figure 5:
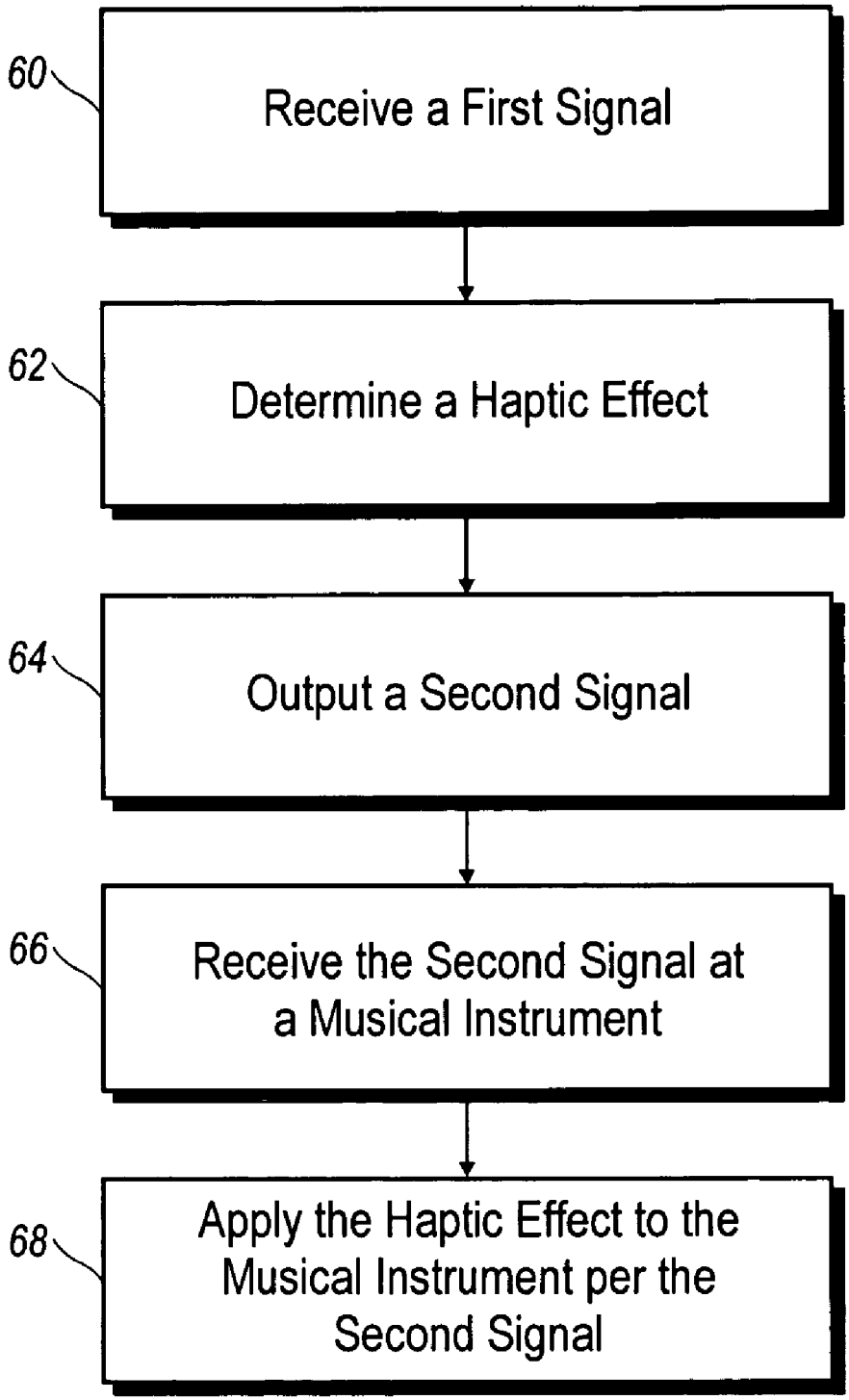
FIG. 5 is a flowchart, illustrating a flow of information between various modules of the firmware in an embodiment of the present invention.

Referring to FIG. 5, a method utilizing an embodiment of the present invention is illustrated. The method can start with a processor 16 receiving a first signal 60. The first signal can be from a sensor detecting a musician playing the instrument, from a memory, from a stored file, e.g., a MIDI file, from another instrument, via a wireless connection, or from any other medium known in the art. The processor 16 receives the first signal and generates one or more second signals associated with one or more haptic effects that correlate to the first signal 62. This can include the processor 16 accessing a look-up table to determine the mapped haptic effect correlated to the first signal or can compute the second signal associated with one or more haptic effects correlated to the first signal. The processor 16 outputs the second signal 64. One or more musical instruments 12 receive the second signal 66. A haptic effect is applied to the musical instrument according to the second signal 68. For example, a local processor (not shown) in the musical instrument 12 can receive the second signal and provide an actuation signal to one or more corresponding actuators 22. The actuation signal comprises an indication that the actuator 22 should actuate (e.g. vibrate or provide resistance). The communication between the actuator 22 and the one or more input members 24 can be configured such that the actuator's actuation provides haptic feedback (e.g., in the form of vibrations or resistance) to the one or more input members 24. In other embodiments, this step can comprise the one or more actuators 22 receiving the second signal from the processor 16 and then actuating to provide the haptic effect to one or more input members 24. The one or more actuators 22 can provide different haptic effects based on the second signal or actuation signal. For example, different haptic effects can be provided by regulating the current delivered to an actuator 22, the duration of the current delivered to an actuator 22, the time cycles between cycles of energizing an actuator 22, and the number of cycles of energizing an actuator 22. These conditions can be varied to produce a variety of haptic effects. The haptic effect can be applied to an input member 24 that caused the first signal, for example a key on a keyboard being pressed down or a string on a guitar being strummed. Alternately, the haptic effect can be applied to the surface or the housing of the musical instrument 12, such as the neck of a guitar. In another embodiment, the haptic effect can be applied to one or more musical instruments 12.

Although the embodiments above apply to musical instruments, the present invention can also be used with other objects, such as communication devices or game controllers for a video game. Communication devices such as cellular telephones or PDAs having one or more actuators can produce haptic effects in response to a triggering event. The triggering events can include pressing one or more keys on a keypad, dialing a telephone number, receiving an incoming call, receiving a message (e.g., missed call, text message), or for indicating a low battery level. In such embodiments, the triggering event produces a first signal which results in one or more corresponding haptic effects being applied to the telephone using the method as described above.

For example, upon a cellular telephone receiving a call or message a first signal is generated. A processor in the telephone receives the first signal and generates one or more second signals associated with one or more haptic effects that correlate to the first signal. This can include the processor accessing a look-up table to determine the mapped haptic effect correlated to the first signal or can compute the second signal associated with one or more haptic effects correlated to the first signal. The processor can output the second signal to one or more actuators with the haptic effects being applied to the telephone according to the second signal 68. Typically, the haptic effects can be in the form of vibrations. In such an embodiment, using caller id, different haptic effects can be applied to the telephone based on the identified caller (e.g., first signal) thereby allowing a person holding the telephone to possibly identify the caller based on the haptic effects.

Regarding game controllers, haptic effects can be applied to the game controller in response to a triggering event such as the game or another player shooting a gun at another player. The haptic effects can be applied to one or both players. For example, a first haptic effect can be applied to a game controller associated with a first player which caused the event, e.g., shooting, and a second haptic effect be applied to a game controller associated with a second player in response to an event, e.g., either the game or another player shooting at the second player. In such embodiments, the first and second haptic effects can be different thus allowing the player to differentiate the events, e.g., shooting at something verse being shot at. In such an embodiment, the first signal can be the game or computer receiving a triggering event, e.g., game or computer generated or input from a game controller. In response to receiving the first signal, a processor in the game or computer can generate one or more second signals associated with one or more haptic effects that correlate to the first signal, e.g., event. This can include the processor accessing a look-up table to determine the mapped haptic effect correlated to the first signal or can compute the second signal associated with one or more haptic effects correlated to the first signal. The processor can output the second signal to one or more actuators in a game controller with the haptic effects being applied to the game controller according to the second signal 68. Typically, the haptic effects can be in the form of vibrations or resistance. The game or computer can be a telephone, e.g., a cellular telephone having one or more games installed on the telephone.

The foregoing description of the preferred embodiments of the invention has been presented only for the purpose of illustration and description and is not intended to be exhaustive or to limit the invention to the precise forms disclosed.

Numerous modifications and adaptations thereof will be apparent to those skilled in the art without departing from the spirit and scope of the present invention.

What is claimed is:

1. A system comprising:

a database comprising at least one haptic effect; and a processor configured to:

receive a first signal having a set of parameters relating to sound, wherein the parameters are compatible with the musical instrument digital interface (MIDI) format;

select the haptic effect from the database, the selection being associated with at least one predetermined parameter from the set of parameters; and output a second signal associated with the haptic effect.

2. The system of claim 1 wherein the processor is configured to receive the first signal from a musical instrument digital interface (MIDI) controller.

3. The system of claim 1 wherein the processor is configured to receive the first signal by reading the first signal from a file.

4. The system of claim 3 wherein the file is a musical instrument digital interface (MIDI) file.

5. The system of claim 1 wherein the processor is configured to receive the first signal from a musical instrument.

6. The system of claim 1 further comprising a musical instrument and at least one actuator configured to cause the haptic effect on an input member of the musical instrument in response to receiving the second signal.

7. The system of claim 1 further comprising a musical instrument and at least one actuator configured to cause the haptic effect on an input member of the musical instrument which caused the first signal in response to receiving the second signal.

8. The system of claim 7 wherein the musical instrument is a keyboard-based instrument, and the input member is selected from the group consisting of a key and a pitch bend.

9. The system of claim 1 further comprising a musical instrument and an actuator, the musical instrument comprising a housing and the actuator coupled to the housing and configured to cause the haptic effect on the housing in response to receiving the second signal.

10. The system of claim 1 further comprising a musical instrument selected from the group consisting of a keyboard, drum pads, wind controller, guitar, electric guitar, and a computer.

11. A method comprising:

reading a first signal from a file, the first signal having a set of parameters relating to sound;

selecting a haptic effect from a database, the selection being associated with at least one predetermined parameter from the set of parameters;

outputting a second signal associated with the haptic effect.

12. The method of claim 11 further comprising causing the haptic effect on an input member of a musical instrument in response to receiving the second signal.

13. The method of claim 11 further comprising causing the haptic effect on an input member of a musical instrument which caused the first signal in response to receiving the second signal.

14. The method of claim 11 further comprising causing the haptic effect on a housing of a musical instrument in response to receiving the second signal.

15. A system comprising:

a processor configured to:

receive a first signal having a set of parameters relating to sound, compute a haptic effect using at least one predetermined parameter from the set of parameters, and output a second signal associated with the haptic effect;

a musical instrument; and at least one actuator configured to cause the haptic effect on an input member of the musical instrument in response to receiving the second signal.

16. The system of claim 15 further comprising a musical instrument and at least one actuator configured to cause the haptic effect on an input member of the musical instrument which caused the first signal in response to receiving the second signal.

17. The system of claim 16 wherein the musical instrument is a keyboard-based instrument, and the input member is selected from the group consisting of a key and a pitch bend.

18. The system of claim 15 wherein, the musical instrument comprises housing, and wherein the actuator is coupled to the housing and is configured to cause the haptic effect on the housing in response to receiving the second signal.

19. The system of claim 15 further comprising a musical instrument selected from the group consisting of a keyboard, drum pads, wind controller, guitar, electric guitar, and a computer.

20. A method comprising:

reading a first signal from a file, the first signal having a set of parameters relating to sound;

computing a haptic effect using at least one predetermined parameter from the set of parameters;

outputting a second signal associated with the haptic effect.

21. The method of claim 20 further comprising causing the haptic effect on an input member of a musical instrument in response to receiving the second signal.

22. The method of claim 20 further comprising causing the haptic effect on an input member of a musical instrument which caused the first signal in response to receiving the second signal.

23. The method of claim 20 further comprising providing the haptic effect on a housing of a musical instrument in response to receiving the second signal.

* * * * *